US007508912B2

(12) United States Patent
Zhong et al.

(10) Patent No.: US 7,508,912 B2
(45) Date of Patent: Mar. 24, 2009

(54) SAGITTAL FOCUSING LAUE MONOCHROMATOR

(75) Inventors: Zhong Zhong, Stony Brook, NY (US); Jonathan Hanson, Wading River, NY (US); Jerome Hastings, Stanford, CA (US); Chi-Chang Kao, Setauket, NY (US); Anthony Lenhard, Medford, NY (US); David Peter Siddons, Cutchogue, NY (US); Hui Zhong, Coram, NY (US)

(73) Assignee: Brookhaven Science Associates, LLC, Upton, NY (US)

( * ) Notice: Subject to any disclaimer, the term of this patent is extended or adjusted under 35 U.S.C. 154(b) by 42 days.

(21) Appl. No.: 11/693,900

(22) Filed: Mar. 30, 2007

(65) Prior Publication Data

US 2008/0247512 A1 Oct. 9, 2008

(51) Int. Cl.
*G21K 1/06* (2006.01)

(52) U.S. Cl. ..... 378/85; 378/84

(58) Field of Classification Search ..... 378/84, 378/85

See application file for complete search history.

(56) References Cited

U.S. PATENT DOCUMENTS 4,365,156 A * 12/1982 Golovchenko et al. ..... 378/84
5,157,702 A * 10/1992 Middleton et al. ..... 378/85
6,038,285 A * 3/2000 Zhong et al. ..... 378/84

OTHER PUBLICATIONS

Zhong et al., Sagittal focusing of high-energy synchrotron x-rays with asymmetric laue crystals. I. Theoretical considerations, 2001, Journal of Applied Crystallography, vol. 34, abstract.*

Zhong et al., "Sagittal Focusing of High-Energy Synchrotron X-rays With Asymmetric Laue Crystals. I. Theoretical Considerations," J. Appl. Cryst., vol. 34, pp. 504-509, 2001.

Carini et al., "High-Energy X-ray Diffraction and Topography Investigation of CdZnTe," Journal of Electronic Materials, vol. 34, No. 6, p. 804, 2005.

Xu et al., "Electric-Field-Induced Redistribution of Polar Nano-Regions in a Relaxor Ferroelectric," Nature Materials, vol. 5, pp. 134-140, 2006.

Zhong et al., "Rocking-Curve Width of Sagittally Bent Laue Crystals," Acta Cryst., A58, pp. 487-493, 2002.

Zhong et al., "A Lamellar Model for the X-ray Rocking Curves of Sagittally Bent Laue Crystals," Acta Cryst., A59, pp. 1-6, 2003.

Zhong et al., "Sagittal Focusing of High-Energy Synchroton X-rays With Asymmetric Laue Crystals. II. Experimental Studies," J. Appl. Cryst. vol. 34, pp. 646-653, 2001.

* cited by examiner

*Primary Examiner*—Edward J Glick
*Assistant Examiner*—Mona M Sanei
(74) *Attorney, Agent, or Firm*—Lori-Anne Neiger

(57) ABSTRACT

An x-ray focusing device generally includes a slide pivotable about a pivot point defined at a forward end thereof, a rail unit fixed with respect to the pivotable slide, a forward crystal for focusing x-rays disposed at the forward end of the pivotable slide and a rearward crystal for focusing x-rays movably coupled to the pivotable slide and the fixed rail unit at a distance rearward from the forward crystal. The forward and rearward crystals define reciprocal angles of incidence with respect to the pivot point, wherein pivoting of the slide about the pivot point changes the incidence angles of the forward and rearward crystals while simultaneously changing the distance between the forward and rearward crystals.

21 Claims, 11 Drawing Sheets

SAGITTAL FOCUSING LAUE MONOCHROMATOR

This invention was made with Government support under contract number DE-AC02-98CH10886, awarded by the U.S. Department of Energy. The Government has certain rights in the invention.

BACKGROUND OF THE INVENTION

The present invention relates generally to a device that provides focusing of divergent high-energy x-rays while maintaining good energy resolution, increasing the useful flux by 1000 over standard techniques. The device solves the problem of ineffective focusing of high-energy x-ray beam lines.

An x-ray produced at a light source will spread out or diverge as it travels from the light source. X-rays produced by a beamline with a 5 milliradian divergence, for example, will spread to 5 millimeters (mm) by the time they are 1 meter away from their source, and to 50 mm when 10 meters away. This is a problem for light source scientists, who want the highest possible x-ray flux on a small spot, which requires a well-focused beam.

Previous technologies for x-ray focusing relied on mirror-like surface reflections to focus x rays. These technologies demonstrated that x-rays can be focused by bending a Bragg crystal. This approach was the first which enabled the use of a synchrotron x-ray beam having a large horizontal divergence. In the years since, the technology has improved to minimize the anticlastic bending which degrades performance of this class of focusing monochromator, but such technologies still required large active surfaces as the x-ray energy increases and/or the grazing incident angle decreases. This requirement causes technical difficulties in error control and there are theoretical limitations on the divergence of the x-rays that can be focused. Moreover, serious theoretical and practical limitations remain, limiting such technologies to low x-ray energies and small x-ray divergence.

For X-rays with energies above 30 keV, the Bragg angle is small and it is difficult to implement traditional sagittal focusing. Because of the decreased Bragg angle, the beam's footprint on the crystal increases. Large crystals, of length approximately 100 mm, must be used, making the control of anticlastic bending difficult, if not impossible. For example, sagittal focusing of X-rays from 40 to 60 keV has been recently achieved by combining specialized bender, high-precision cutting of hinged crystals and higher index diffraction to increase the Bragg angle. Also, at high x-ray energies, the energy bandwidth of the monochromatic beam created is dominated by the vertical opening angle of the beam, which is of the order of a few tenths of a milliradian. The resulting energy resolution may be unacceptable for some applications. Finally, the bending radius required becomes extremely small at high x-ray energies, requiring extremely thin crystals, which is impractical for such long crystals.

The recent availability of powerful, third-generation high-energy synchrotron radiation sources, such as the APS in the United States, the ESRF in France, and Spring-8 in Japan, has pushed the spectrum of x-rays to much higher energies than imaginable two decades ago. Since no practical method has been available to focus a large divergence of high-energy x-rays, beamlines at these facilities were forced to use either lower energy x-rays or a tiny part of the large horizontal fan beam.

Accordingly, it would be desirable to provide an x-ray focusing device that focuses a large horizontal divergence (e.g., up to 20 milliradians) of high-energy x-rays (e.g., above 50 keV) without relying on a crystal surface to reflect an x-ray beam. It would be further desirable to provide a device that makes an incident fan of white x-rays (e.g., up to 200 mm wide), from a synchrotron-radiation source, monochromatic with high energy-resolution and focuses the beam to a small point (e.g., less than 0.5 mm wide).

SUMMARY OF THE INVENTION

Unlike prior art devices, the present invention utilizes a set of Laue crystals, named for German physicist Max von Laue, to diffract an x-ray beam, as opposed to reflecting the beam. Specifically, the invention uses the lattice planes inside such crystals to monochromatize and focus the x-rays, thus allowing them to be almost perpendicular to the surface of the crystal. The transmission geometry renders the beam's illumination length small, reducing the control of the crystal's figure-error from a two-dimensional problem to a one-dimensional one. This new concept takes advantage of the fact that high-energy x-rays have enough penetrating power to go through the thickness of the Laue crystal.

Thus, the present invention is an x-ray focusing device, which generally includes a slide pivotable about a pivot point defined at a forward end thereof, a rail unit fixed with respect to the pivotable slide, a forward crystal for focusing x-rays disposed at the forward end of the pivotable slide and a rearward crystal for focusing x-rays movably coupled to the pivotable slide and the fixed rail unit at a distance rearward from the forward crystal. The forward and rearward crystals define reciprocal angles of incidence with respect to the pivot point, wherein pivoting of the slide about the pivot point changes the incidence angles of the forward and rearward crystals while simultaneously changing the distance between the forward and rearward crystals.

In a preferred embodiment, the x-ray focusing device further includes a forward carriage fixed to the forward end of the pivotable slide for supporting the forward crystal and a movable rearward carriage for supporting the rearward crystal linearly translatable along the pivotable slide and along the fixed rail unit. The rearward carriage defines a fixed distance between the rearward crystal and the fixed rail unit, which causes the simultaneous translating and pivoting motions. In this regard, the movable rearward carriage preferably includes a rotatable bearing to allow for varying angles between the pivotable slide and the fixed rail unit.

The fixed rail unit preferably includes a linear translation device for linearly translating the rearward crystal along the pivotable slide. The linear translation device preferably includes a lead screw coupled to the rearward crystal and a motor for rotating the lead screw, wherein the rearward crystal is linearly translated along the pivotable slide. The linear translation device can further include a translation arm threadably coupled to the lead screw, wherein the translation arm defines a fixed distance between the rearward crystal and the lead screw.

In the preferred embodiment, the forward and rearward crystals are sagittally bent Laue crystals having asymmetric lattice planes for focusing and diffracting x-rays. Also, the x-ray focusing device preferably includes forward and rearward bending units for respectively adjusting the sagittal bend of the forward and rearward crystals. Each bending unit preferably includes a pair of deflectable arms having the crystal attached therebetween, wherein deflection of at least one of the deflectable arms symmetrically bends the crystal about a centerline defined between the arms. The bending unit can further include a base, a fixed support attached to the base and having one end of a first deflectable arm attached thereto, a movable support disposed on the base and having one end of a second deflectable arm attached thereto, a translation mechanism for moving the movable support with respect to the fixed support to deflect the second deflectable arm and a pair of clamping members disposed on respective ends of the first and second deflectable arms opposite the fixed support and the movable support, wherein the crystal is attached between the clamping members. In addition, the translation mechanism is preferably a picomotor.

Also, the forward and rearward incidence angles of the crystals are preferably reciprocal angles, whereby an x-ray beam emerging from the rearward crystal is substantially parallel to an incident beam striking the forward crystal. With this arrangement, the pivot point and the fixed rail unit are preferably fixed on a base so that the pivot point is positioned about midway between the incident x-ray beam striking the forward crystal and the resultant x-ray beam emerging from the rearward crystal.

The present invention further involves a method for changing the energy of an x-ray beam focused in a device as described above. The method generally includes the step of translating the rearward crystal along the pivotable slide with respect to the forward crystal, thereby changing the distance therebetween, wherein this translation simultaneously pivots the slide about the pivot point thereby changing the incidence angles of the forward and rearward crystals. Changing the angles at which the x-rays strike the forward and rearward crystals results in a change of energy of the resultant monochromatic x-ray.

In a preferred embodiment, the fixed rail unit includes a lead screw coupled between a motor and the rearward crystal, and the translating step includes the step of rotating the lead screw with the motor to translate the rearward crystal along the pivotable slide. This step further preferably involves maintaining a fixed distance between the lead screw and the rearward crystal.

The method according to the present invention preferably involves sagittally bent Laue crystals having asymmetric lattice planes for focusing and diffracting x-rays, wherein the focusing of these crystals can be adjusted by changing their bend. In addition, the forward and rearward incidence angles of the crystals are preferably reciprocal angles, whereby the method according to the present invention results in an x-ray beam emerging from the rearward crystal being substantially parallel to an incident beam striking the forward crystal.

As a result of the present invention, the lattice planes inside a Laue crystal are beneficially utilized to monochromatize and focus x-ray beams, thus allowing them to be almost perpendicular to the surface of the crystal. The Laue geometry of the crystals provides advantageous anticlastic bending with reduced cost and ease of operation. Moreover, simple linear translation capabilities of the present invention allows for one-motion tuning of x-ray energy. Therefore, in addition to gains of focusing, an order-of-magnitude increase in the monochromatic intensity can be achieved while providing better energy resolution, compared to existing prior art Bragg crystals.

The preferred embodiments of the x-ray focusing device of the present invention, as well as other objects, features and advantages of this invention, will be apparent from the following detailed description, which is to be read in conjunction with the accompanying drawings. The scope of the invention will be pointed out in the claims.

DETAILED DESCRIPTION OF THE PREFERRED EMBODIMENTS

In general, the present invention uses sagittally bent asymmetric Laue crystals to achieve horizontal focusing of x-ray beams. The physics behind sagittal focusing with a sagittally bent asymmetric Laue crystal 12 is shown in FIGS. 1-7 and explained in detail in Zhong et al., "Sagittal Focusing of High-Energy Synchrotron X-rays with Asymmetric Laue Crystals. I. Theoretical Considerations," *Journal of Applied Crystallography*, ISSN 0021-8898, Vol. 34, pp. 504-509 (2001) and Zhong et al., "Sagittal Focusing of High-Energy Synchrotron X-rays with Asymmetric Laue Crystals. II. Experimental Studies," *Journal of Applied Crystallography*, ISSN 0021-8898, Vol. 34, pp. 646-653, (2001), both of which are incorporated herein by reference.

As explained in these papers, it has been found that sagittally bending an asymmetric Laue crystal creates a focusing device which can be used to advantageously focus a divergent beam of x-rays. As used herein, the term "sagittally bent" means that the crystal is horizontally or vertically bent from an initial flat planar orientation to a curved orientation. The term "asymmetric" refers to a crystal whose lattice planes are not normal to the incident crystal surface. Thus, FIGS. 1-6 show such a crystal 12 (bent horizontally) diffracting a horizontal fan beam 14. Because of the sagittal bending, the diffraction vector H of the crystal 12 along the fan beam 14 precesses around the axis of sagittal bending, thus focusing the diffracted beam 16.

Figure 1:
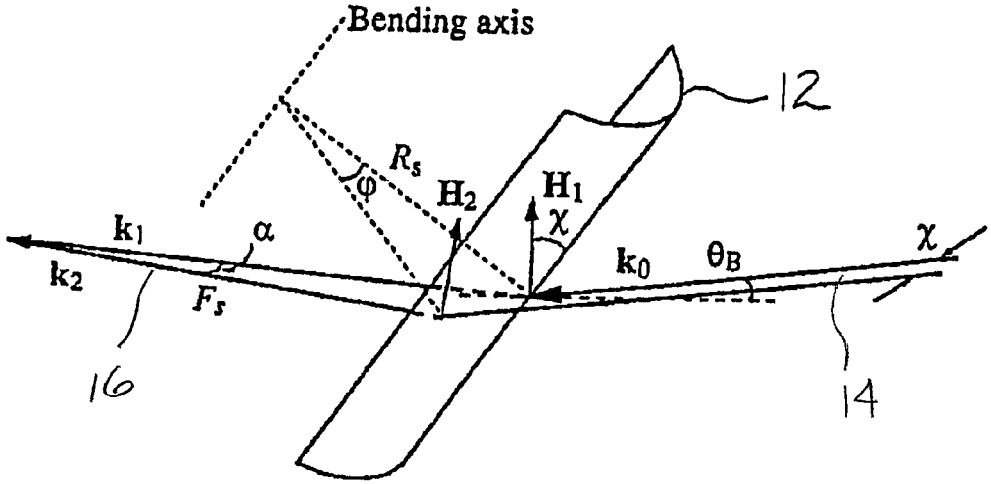
FIG. 1 is a real-space diagram showing two parallel incident x-ray beams being monochromatized and sagittally focused at a focal distance of $F_s$.
Figure 2:
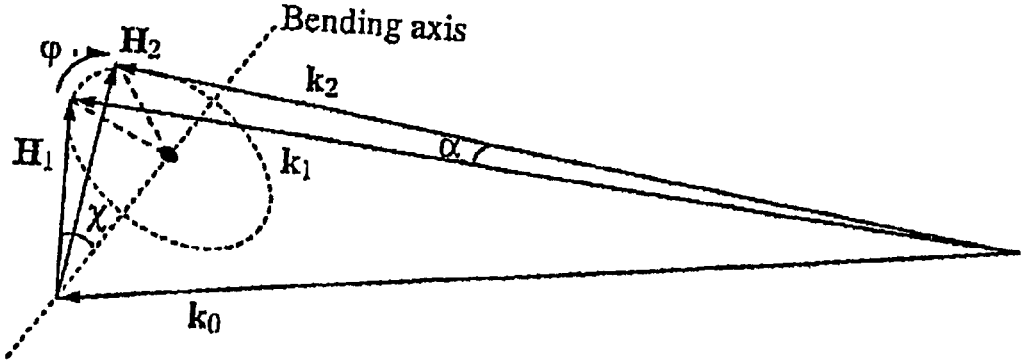
FIG. 2 is a reciprocal-space diagram of FIG. 1 showing the precession of the diffraction vectors $H_1$ and $H_2$ around the axis of sagittal bending, and the resulting angle ▫between wave vectors $k_1$ and $k_2$ of the diffracted beams.
Figure 3:
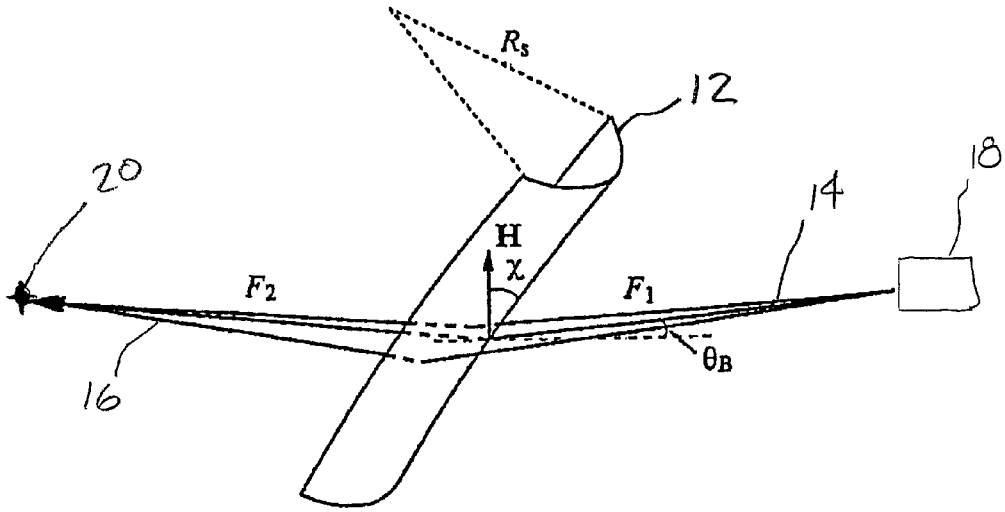
FIG. 3 is a side view of a single sagittally bent Laue crystal focusing a diverging horizontal fan-shaped beam.
Figure 4:
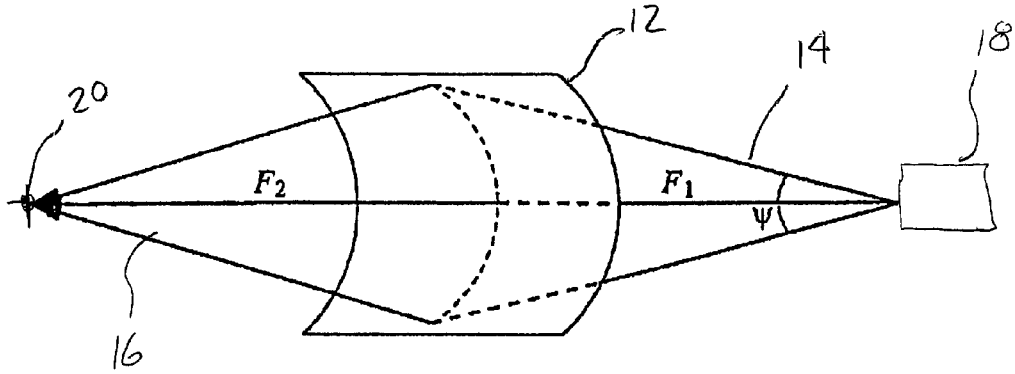
FIG. 4 is a top view of the Laue crystal shown in FIG. 3.

FIGS. 1 and 2 depict the change (in the plane perpendicular to the scattering plane) of the direction of the diffracted x-rays in real and reciprocal space. Two incident x-ray beams are considered and assumed to be parallel, with wave vector $k_0$. The first beam strikes the center of the crystal and is diffracted by the diffraction vector $H_1$ into a direction indicated by $k_1=k_0+H_1$. The second beam is in the same horizontal plane as the first one, at a distance x from it. At the point where the second X-ray beam meets the crystal, the crystal's diffraction vector, $H_2$, precesses by an angle $\Phi$ around the axis of sagittal bending. This causes a change, $\alpha$, of the direction of the diffracted X-rays of the second beam ($k_2=k_0+H_2$) with respect to those of the first beam. The change, $\alpha$, is perpendicular to the diffraction plane for a small $\Phi$.

The magnitudes of $\Phi$ and $\alpha$ are related to $\Delta H=|H_1-H_2|$ and x by $$\Delta H=2H\sin\chi\sin(\Phi/2)=2k\sin(\alpha/2) \quad (1)$$

and $$x=R_s\sin\Phi, \quad (2)$$

where H is the magnitude of the diffraction vectors $H_1$ and $H_2$, k is the magnitude of the wave vectors $k_0$, $k_1$ and $k_2$, $R_s$ is the radius of the sagittal bending, $\chi$ is the asymmetry angle defined as the angle between the crystal surface normal and the Bragg planes used for reflecting the x-rays, and x is the horizontal width of the incident beam.

Using equations (1) and (2), and $H-2k\sin\theta_B$, the sagittal focal length $F_s=x/\alpha$ is calculated:

$$F_s=\pm R_s/2\sin\theta_B\sin\chi, \quad (3)$$

where $\theta_B$ is the Bragg angle of reflection. The upper sign is used ($F_s$ is positive) if the diffraction vector is on the same side of the crystal as the center of the sagittal bending, i.e., the diffraction Vector is on the concave side of the sagiffally bent crystal, thereby focusing the x-rays. The situations shown in FIGS. 1-4 correspond to this case. $F_s$ is negative (lower sign) if the diffraction vector is on the convex side of the crystal, causing further divergence of the horizontal x-rays.

Equation (3) can be compared with that of the focal length of a sagittally focusing symmetric Bragg crystal, $F_{Bragg}=R_s/(2\sin\theta_B)$. The focal length of a sagittal Laue crystal is a factor of $1/\sin\chi$ longer (typically a factor of 1.5 to 2) than that of a Bragg crystal bent to the same radius.

Equation (3) shows that the sagittal focal length is infinity when the asymmetry angle is zero. Thus, a symmetrical Laue crystal does not have any sagittal focusing effect. This can be easily understood by considering the diffraction vectors $H_1$ and $H_2$ in FIGS. 1 and 2. The diffraction vectors would all point along the bending axis of the crystal, regardless of their positions, so that there would be no change in the direction of the diffracted x-rays in the sagittal plane.

Utilization of a Laue crystal 12 differs from the prior art Bragg reflection crystals in that the x-rays pass through the body of the crystal and are diffracted, rather than being reflected from a surface. At high energies, the incidence angle for the x-rays becomes very small. For the Bragg crystal, this implies a large illuminated crystal area, thereby placing serious constraints on the tolerance of optical figure efforts. In the Laue crystal 12, the beams are almost perpendicular to the surface, and so the illuminated area is small and essentially unaffected by changes in energy.

Figure 5:
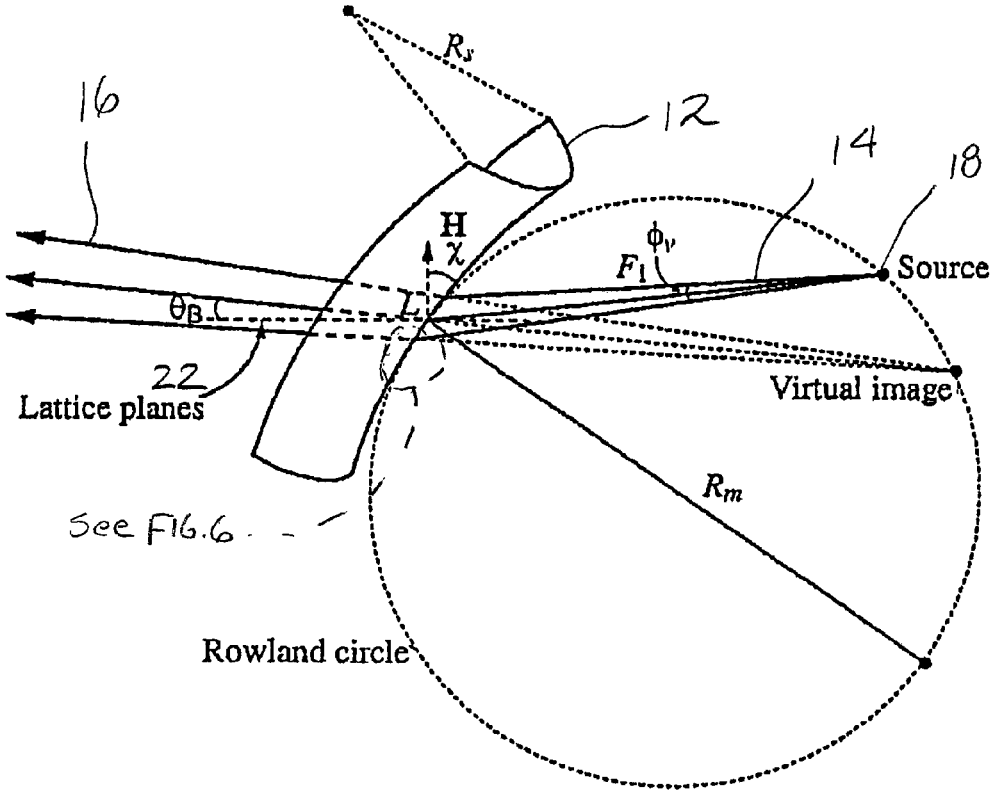
FIG. 5 shows the arrangement of inverse-Cauchois geometry in the meridional plane to take advantage of the anticlastic bending of a sagittally bent asymmetric Laue crystal.
Figure 6:
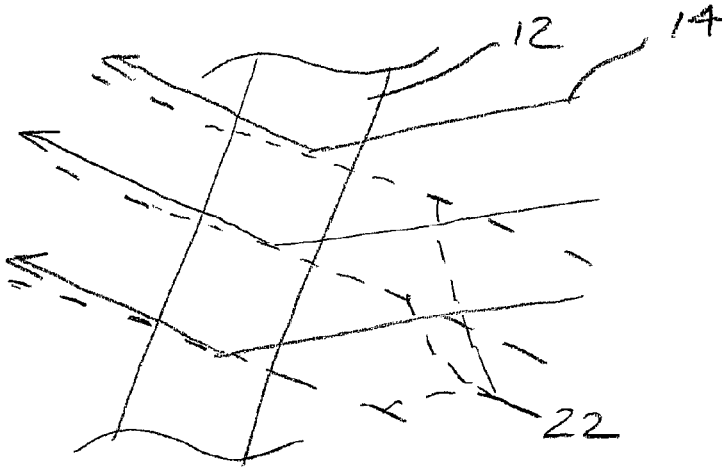
FIG. 6 is an enlarged cross-sectional view of the Laue crystal shown in FIG. 5 showing the x-ray beams being diffracted by the lattice planes of the crystal.

FIGS. 3-6 show a Laue crystal 12 sagittally focusing a diverging horizontal fan-shaped beam 14 from a synchrotron x-ray source 18, wherein F1 and F2 are the distances from the source to the crystal and the distance from the crystal to the focal point 20, respectively. As can be seen in FIGS. 5 and 6, the x-ray beam 14 passing through the Laue crystal 12 is reflected by the lattice planes 22 causing the beam to be diffracted, while the curvature of the crystal simultaneously converges the beam.

Figure 7:
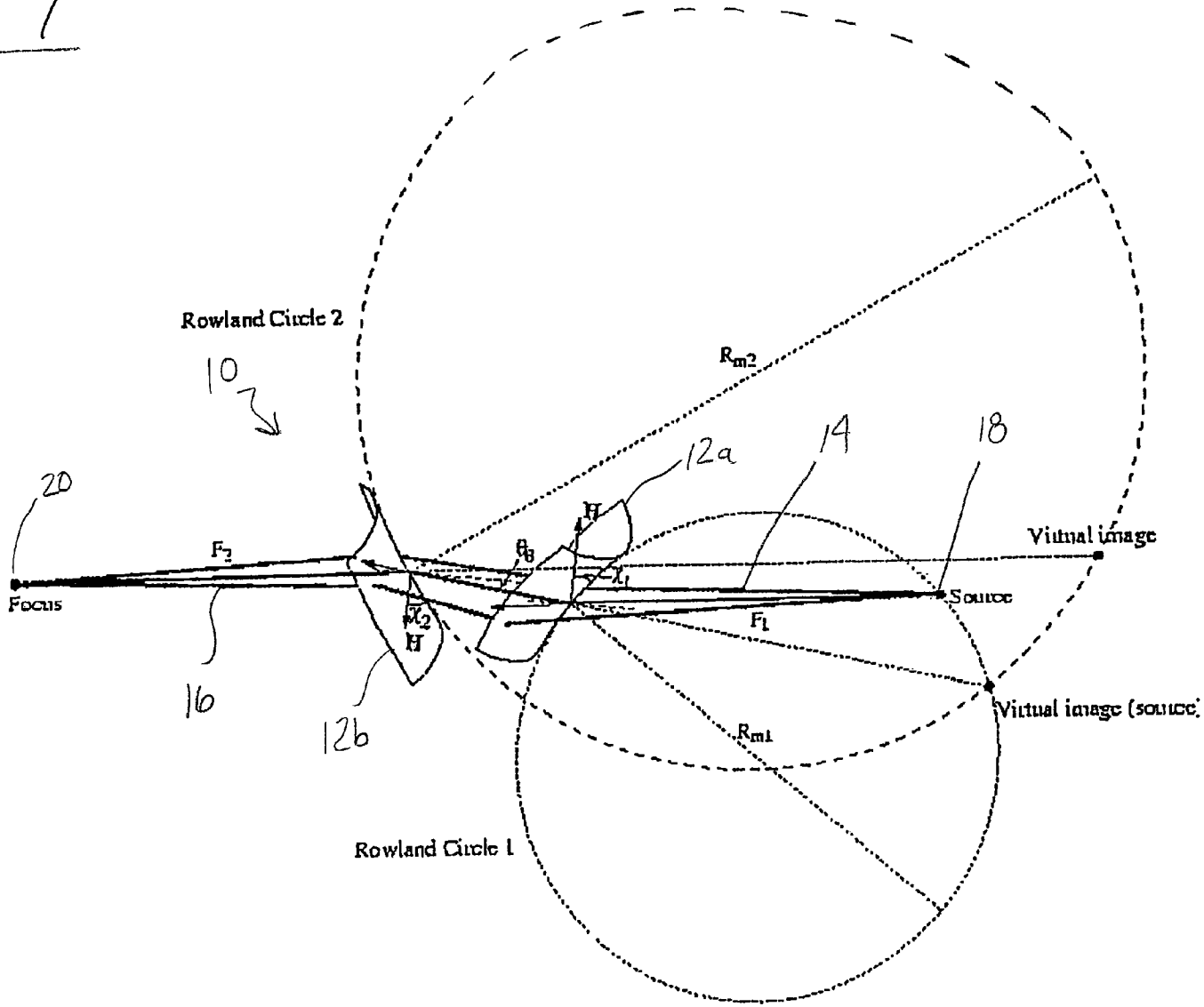
FIG. 7 is a diagrammatic illustration of a fixed-exit monochromator using two sagittally bent Laue crystals.

For synchrotron x-ray beamlines, it is desirable to have a double-crystal monochromator to keep the beam direction horizontal and to maintain a fixed beam exit as the energy is changed. FIG. 7 schematically shows such a double-crystal monochromator. The first crystal 12*a* diffracts up and is curved sagittally upward so that the diffraction vector is on its concave side. The diffraction vector of the second crystal 12*b* points down, but since it is curved in the opposite way to the first crystal, the diffraction vector is still on the concave side of its sagittal bending. Thus, both crystals contribute to the sagittal focusing.

FIG. 7 shows a vertical cross-section (meridional plane) of the monochromator 10. The crystals 12*a* and 12*b* have a curvature (anticlastic bending) in this plane because of the elastic bending in the horizontal plane. If the same asymmetry angle ($\chi=\chi_1+\chi_2$) is used for both crystals 12*a* and 12*b*, then the bending radii of the two crystals need to differ by a factor of $\cos(\chi-\theta_B)/\cos(\chi+\theta_B)$. Since this factor is close to unity at typical asymmetry angles for small Bragg angles corresponding to high-energy x-rays, the easiest approximation to this ideal case is to use two crystals of the same asymmetry angle and bending radius.

The anticlastic bending of the crystals 12*a* and 12*b* allows the lattice planes 22 to have the same angle with the diverging x-rays 14 from the source 18 (inverse-Cauchois geometry) in the meridional plane to provide better energy-resolution when compared to traditional sagittal focusing with Bragg crystals. Anticlastic bending of sagittal-focusing Bragg crystals results in serious loss of aperture unless very complex crystal geometries are adopted. Selection of the asymmetry angle (the angle between the lattice planes 22 and the crystal normal) of the Laue crystals 12 can simultaneously provide sagittal focusing and optimum energy resolution of 0.01% (dE/E).

Figure 8:
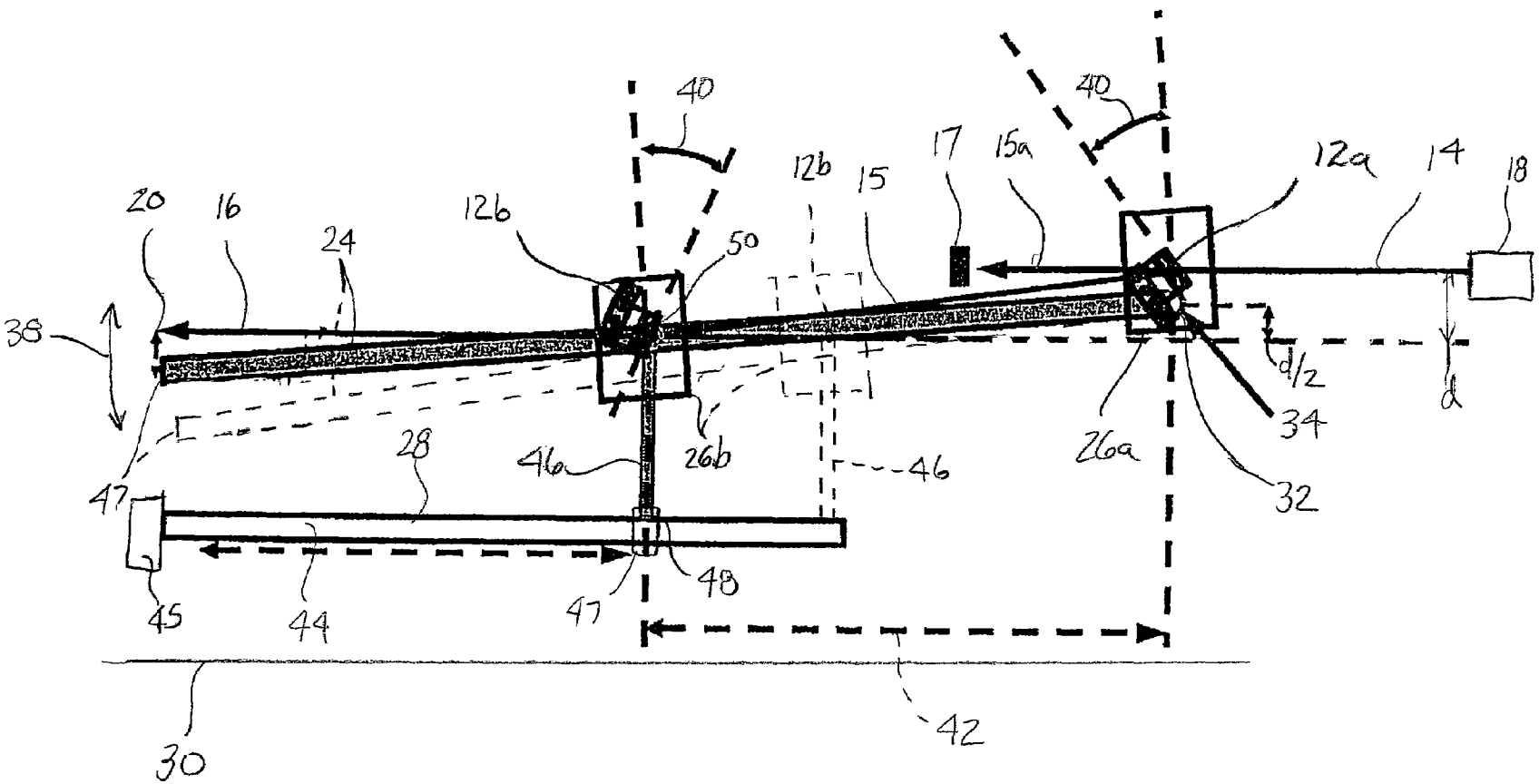
FIG. 8 is a schematic side view of the x-ray focusing device of the present invention.
Figure 9:
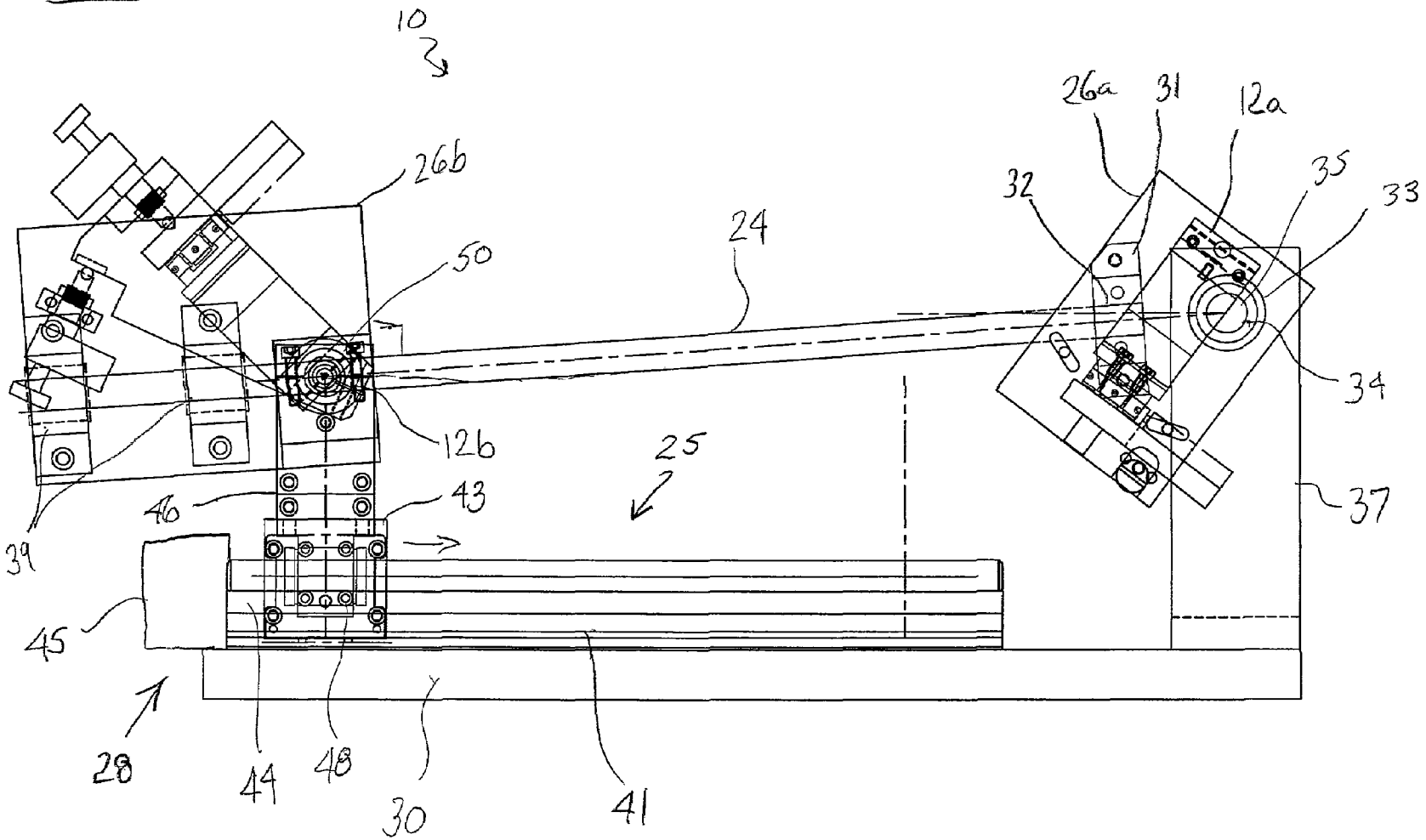
FIG. 9 is a side view of a preferred embodiment of the x-ray focusing device of the present invention.
Figure 9A:
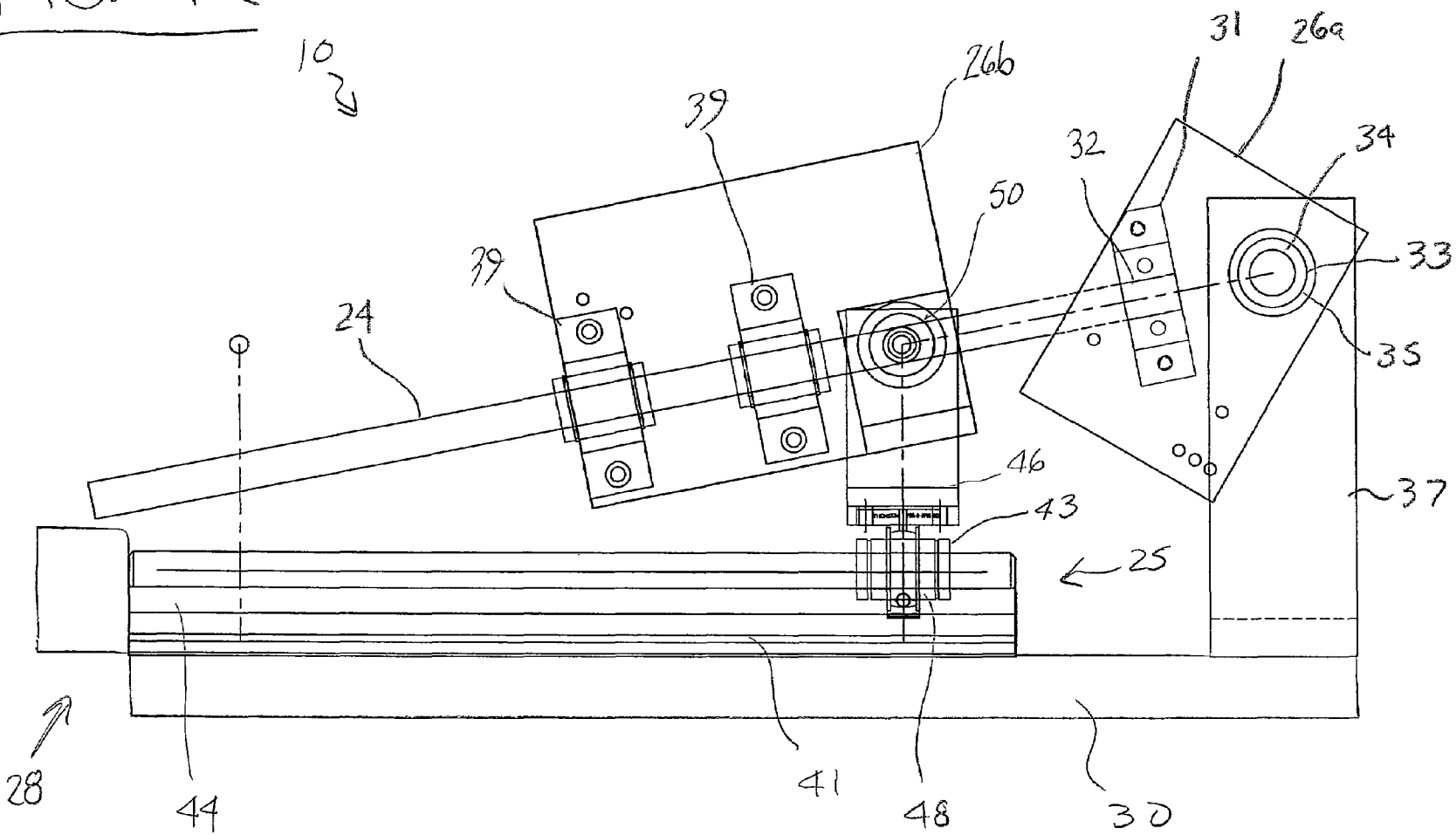
FIG. 9*a* is a side view of the x-ray focusing device shown in FIG. 9 with the rearward carriage moved to a forward position and the crystals not shown for clarity.
Figure 10:
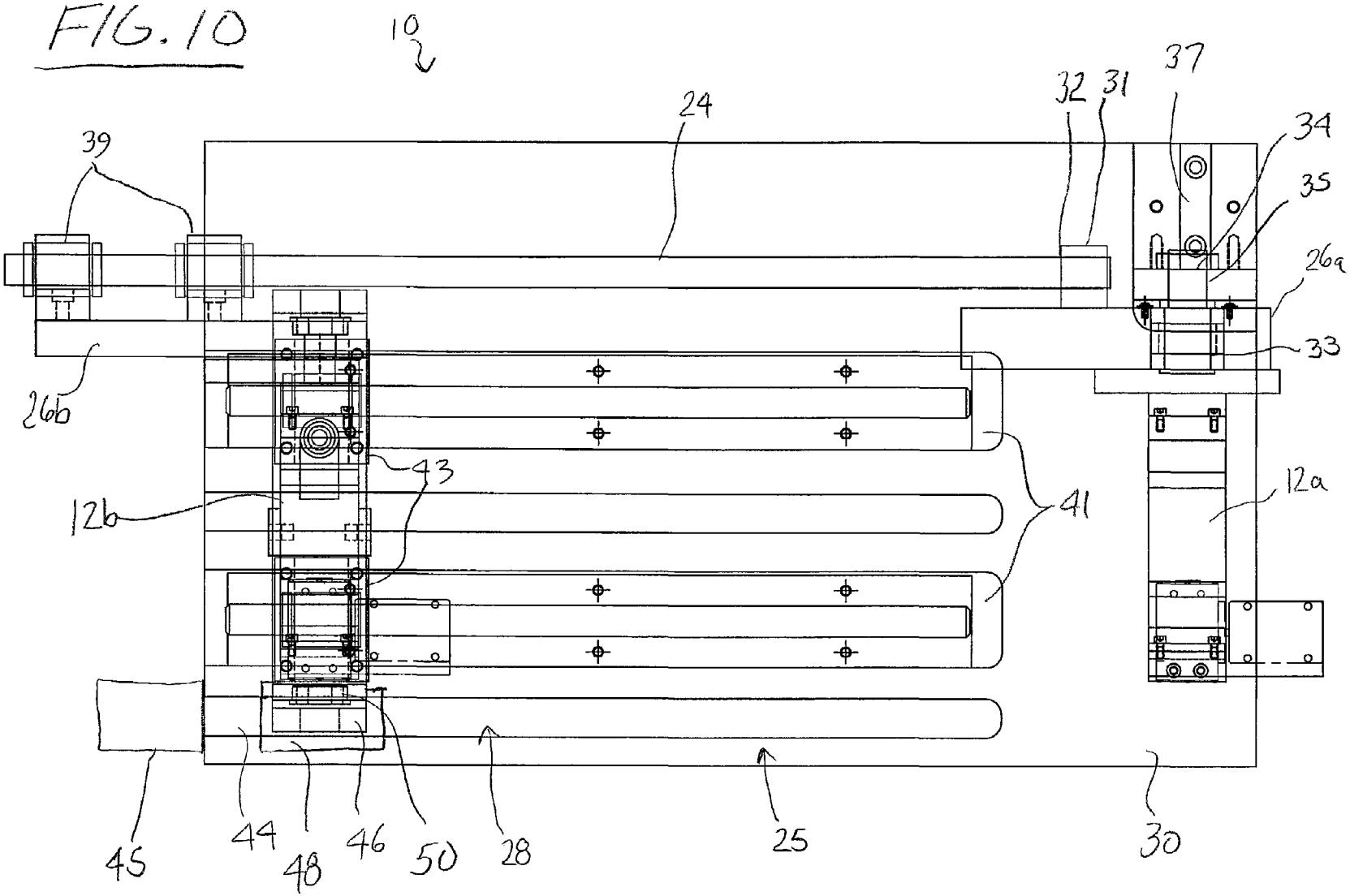
FIG. 10 is a top view of the x-ray focusing device shown in FIG. 9.

Turning now to FIG. 8, the x-ray focusing device 10 of the present invention, termed a sagittal focusing Laue monochromator, is shown in schematic form. The device 10 of the present invention utilizes two sagittally bent Laue crystals 12*a* and 12*b* to focus a divergent x-ray beam 14 from a light source 18 to form a monochromatic beam 16 converging at a focal point 20. The first crystal 12*a*, closer to the source 18, is angled with respect to the source to diffract the x-ray beam 14 upwardly and the second crystal 12*b*, further from the source, is angled to diffract the upwardly deflected beam 15 downwardly, so that the output beam 16 remains horizontal and parallel to the input beam 14. A beam stop 17, made from a suitable x-ray absorbing material, such as copper, is preferably provided behind the first crystal 12*a* along the path of the incident beam 14 to absorb the portion 15*a* of the incident x-ray beam not diffracted by the first crystal. As described above with respect to FIGS. 1-7, because both crystals 12*a* and 12*b* are also sagittally bent, both crystals 12*a* and 12*b* also contribute to horizontal focusing.

Referring additionally to FIGS. 9-12, the monochromator 10 of the present invention generally includes a pivotable rail or slide 24, a fixed rail unit 25 and two carriages 26*a* and 26*b* supported on the slide. As will be discussed in further detail below, in a preferred embodiment, the fixed rail unit 25 includes a linear translation device 28 for translating a movable rearward carriage 26*b* with respect to a forward fixed carriage 26*a*. The pivotable slide 24 and the fixed rail unit are preferably supported on a base 30. As will also be explained in further detail below, the monochromator 10 of the present invention allows one-motion changing of x-ray energy along the beam direction via the interaction of the pivotable slide 24 and the fixed rail unit 25.

The two crystals 12*a* and 12*b* are mounted on respective carriages 26*a* and 26*b*, which in turn are both supported on the pivotable slide 24. In a preferred embodiment, two thin 001 silicon crystals 12*a* and 12*b*, having a thickness of between 0.4 and 0.7 mm, are used. However, Laue crystals made from other materials, such as germanium, quartz, etc., may also be used. The first crystal 12*a*, closer to the x-ray source 18, is mounted to a first carriage 26*a*, which is both linearly and rotationally fixed to a forward end 32 of the pivotable slide 24. The second crystal 12*b*, further from the x-ray source 18, is mounted to a second carriage 26*b*, which is free to linearly move along the length of the pivotable slide 24.

The two crystals 12*a* and 12*b* are positioned on their respective carriages 26*a* and 26*b* at a fixed angle 40 with respect to the pivotable slide 24, such angle being the same for both crystals but in opposite directions. In a preferred embodiment, the fixed angle 40 for the crystals 12*a* and 12*b* with respect to the pivotable slide 24 is set at +35.3° and −35.3°, respectively. Thus, the first crystal 12*a* will deflect an incident white x-ray beam 14 in a first direction, as shown by beam 15 in FIG. 8, and the second crystal 12*b* will deflect the once deflected beam 15 in a second opposite direction, wherein the twice deflected beam 16 will emerge from the second crystal 12*b* in a direction parallel to the incident beam direction but spaced at a distance d from the incident beam 14. In addition to deflecting the beams by diffraction, the sagittally bent crystals 12*a* and 12*b* focus the divergent white beam 14 in two steps to produce a monochromatic beam 16.

The forward end 30 of the pivotable slide 24 pivots about a pivot point 34 having a rotational axis extending perpendicular to the plane of the paper in FIG. 8. Thus, the rearward free end 36 of the pivotable slide 24 can swing through an arc as shown by the arrow 38 in FIG. 8. In a preferred embodiment, the forward carriage 26*a* is mounted to the forward end 32 of the slide 24 via a fixed mounting bracket 31 and includes a rotational bearing 33, which cooperates with a pin 35 fixed to a support bracket 37 mounted to the base 30. Of course, this arrangement can be reversed, wherein the pin 35 is provided on the carriage 26*a* and the bearing 33 is provided on the support bracket 37. In either case, the pin 35 defines the pivot point 34 and the axis of rotation for the pivotable slide 24.

As shown in FIG. 8, the pivot point 34 of the slide 24 is positioned between the incident white beam 14 and the twice deflected monochromatic beam 16. Thus, the first crystal 12*a* is offset on its respective carriage 26*a* so as to be placed in the path of the incident beam 14. Best results have been achieved when the pivot point 34 is positioned midway between the incident white beam 14 and the twice deflected monochromatic beam 16.

As mentioned above, the second crystal 12*b* is mounted to a second or rearward carriage 26*b*, which is free to linearly move along the length of the pivotable slide 24. In this regard, the pivotable slide 24 is preferably a hardened precision ground member which permits free movement of the movable rearward carriage 26*b* along its length. Also in a preferred embodiment, the rearward carriage 26*b* includes a pair of axially aligned linear bearings 39, which receive the pivotable slide 24 to slidably couple the rearward carriage to the slide.

As mentioned above, the present invention further includes a fixed rail unit 25, which, together with the pivotable slide, provides one-motion changing of x-ray energy along the beam direction. In one embodiment of the present invention, the fixed rail unit 25 can simply include one or more fixed rails 41 provided on the base 30, and extending in the same longitudinal direction as the pivotable slide 24, with the rearward carriage 26*b* movably coupled therebetween. These fixed rails can be in any form so as to permit free horizontal movement of the rearward carriage 26*b*. Preferably, the movable rearward carriage 26*b* includes linear bearings 43, which cooperate with the fixed rails 41 to facilitate such free movement of the carriage. As will now be described, such linear movement of the carriage 26*b*, toward or away from the pivot point 34 of the pivotable slide 24, will result in a change of energy of the resultant monochromatic beam 16.

In particular, the energy E of the resulting monochromatic x-ray beam is dependent on the angle θ at which the incident beam 14 intersects the lattice planes of the crystals separated by a fixed distance d by the equation $$E=12.4/\lambda \tag{4}$$

where $$\lambda=2d\sin\theta. \tag{5}$$

Thus, the energy of the resulting monochromatic x-ray beam 16 can be varied by rotating the crystals 12*a*, 12*b* with respect to the x-ray source 18. However, both crystals 12*a* and 12*b* must be rotated by the same amount and must maintain their orientation with respect to each other so as to produce a monochromatic beam 16 parallel to the incident white beam 14. Specifically, because the angle at which the once deflected beam 15 leaving the first crystal 12*a* will change when rotating the first crystal, the distance 42 between the crystals 12*a* and 12*b* must change to position the second crystal 12*b* in the new path of the once deflected beam 15. Such movement of the carriage 26*b* with crystal 12*b* in one direction is shown in dashed lines in FIG. 8.

It is conceivable that the device 10 of the present invention can be operated manually by simply pivoting the rearward free end 47 of the slide 24 about the pivot point 34 to change the incident angle of each crystal 12*a* and 12*b*, or by manually sliding the movable carriage 26*b* along the length of the pivotable slide 24, or along the length of the fixed rails 41 of the fixed rail unit 25, to change the distance between the two crystals 12*a* and 12*b*. As will be explained in further detail below, due to the mechanical arrangement between the pivotable slide 24, the fixed rail unit 25 and the two carriages 26*a* and 26*b*, pivoting of the pivotable slide will result in linear translation of the rearward carriage and vise versa.

In the preferred embodiment, however, the fixed rail unit 25 includes a linear translation device 28 to simultaneous rotate the crystals 12*a* and 12*b* and linear translate the second crystal 12*b* with respect to the first crystal 12*a*. The linear translation device 28 is preferably provided in addition to the fixed rail members 41. However, it is conceivable to do without the fixed rail members 41 if the linear translation device 28 is provided.

In either case, the linear translation device 28 preferably includes a lead-screw 44, a motor 45 for rotating the lead screw and a translation arm 46. The translation arm 46 includes an internally threaded bearing 48 at one end thereof which is threadably connected to the lead-screw 44 for linear motion. The translation arm 46 further includes a one or more rotational bearings 50 opposite the threaded bearing 48 for pivotable attachment to the slidable carriage 26*b*. The axis of rotation of the rotational bearing 50 intersects the longitudinal axis of the slide 24 and the translation arm 46 has a fixed length between the rotational bearing 50 and the internally threaded bearing 48. In this manner, a constant vertical distance is maintained between the rotational bearing 50 and the base 30 and, more importantly, a constant vertical distance is maintained between the center of the rotational bearing 50 and the fixed pivot point 34 of the slide.

Thus, rotation of the lead screw 44 by the motor 45 will cause the translation arm 46, and in turn the movable carriage 26*b*, to move toward or away from the fixed pivot point 34 of the slide 24. As can be appreciated, by virtue of the slide 24 being pivotably fixed at the pivot point 34, translation of the slidable carriage 26*b* along the slide will cause the slide to pivot along the arc 38 about the pivot point. This pivoting of the slide 24 will change the incident angle of each crystal 12*a* and 12*b*, thereby changing the energy of the resulting monochromatic beam 16. At the same time, the slidable carriage 26*b* is translated into an appropriate horizontal position so as to intersect the once deflected beam 15 and further deflect the monochromatic beam 16 in a direction parallel to the incident beam 14. Thus, the linear translation device 28 of the present invention allows for simultaneous changing of the incident angle of both crystals 12*a* and 12*b* by the same amount (thus maintaining the parallelism between the lattice planes of both crystals), and a lateral translation of the second crystal 12*b* of exactly the same amount as is required to position the diffracted beam 15 from the first crystal 12*a* onto the center of the second crystal 12*b*.

An example of the dimensional parameters for a preferred device 10 is as follows. In a preferred embodiment, with the angle of the crystals 12*a* and 12*b* respectively set at ±35.3° with respect to the slide 24, the fixed pivot point 34 of the slide is spaced 25 mm from the incident beam 14 in the vertical direction and the device 10 is designed to permit the distance 42 between the first and second crystals 12*a* and 12*b* to vary from between about 250 mm (which will result in a monochromatic beam having an energy of about 20 keV) to about 700 mm (which will result in a monochromatic beam having an energy of about 55 keV). This will result in the free end 34 of the slide 24 being able to be pivoted in a 45 mm range at angles between about 2-6° degrees.

Figure 13:
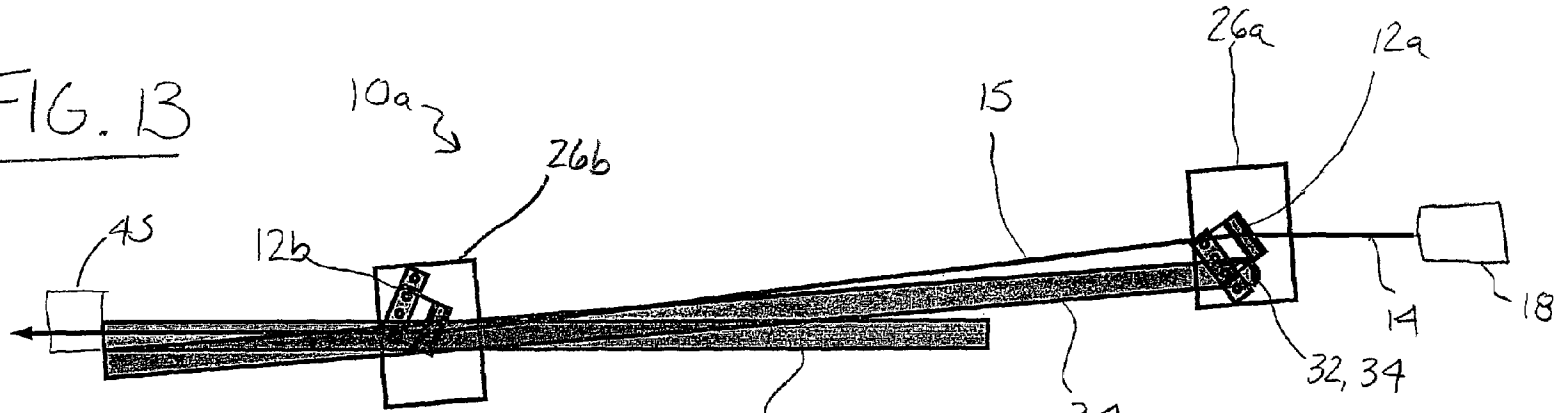
FIG. 13 is a side view of an alternative embodiment of the x-ray focusing device of the present invention.
Figure 14:
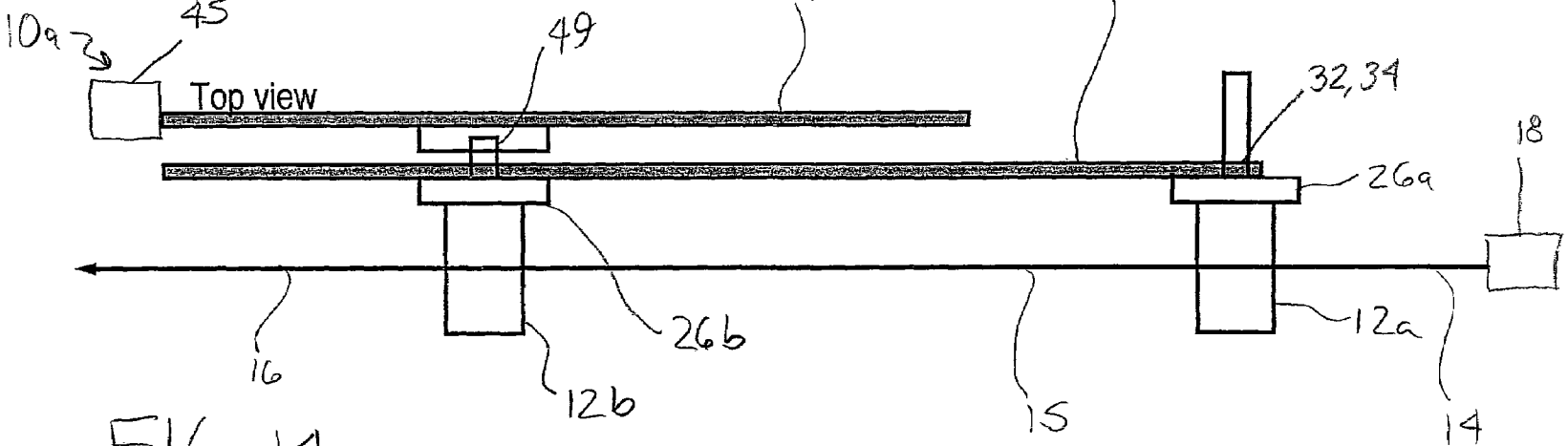
FIG. 14 is a top view of the x-ray focusing device shown in FIG. 13.

In an alternative embodiment, as shown in FIGS. 13 and 14, the device 10*a* can utilize a "cross-slide" design, thereby eliminating the translation arm 46. In this embodiment, the lead screw 44 can be threadably coupled directly to the movable carriage 26*b* via a rotatable bearing 49. Thus, rotation of the lead screw 44 by the motor 45 will translate the movable carriage 26*b* directly along the slide 24.

Figure 11:
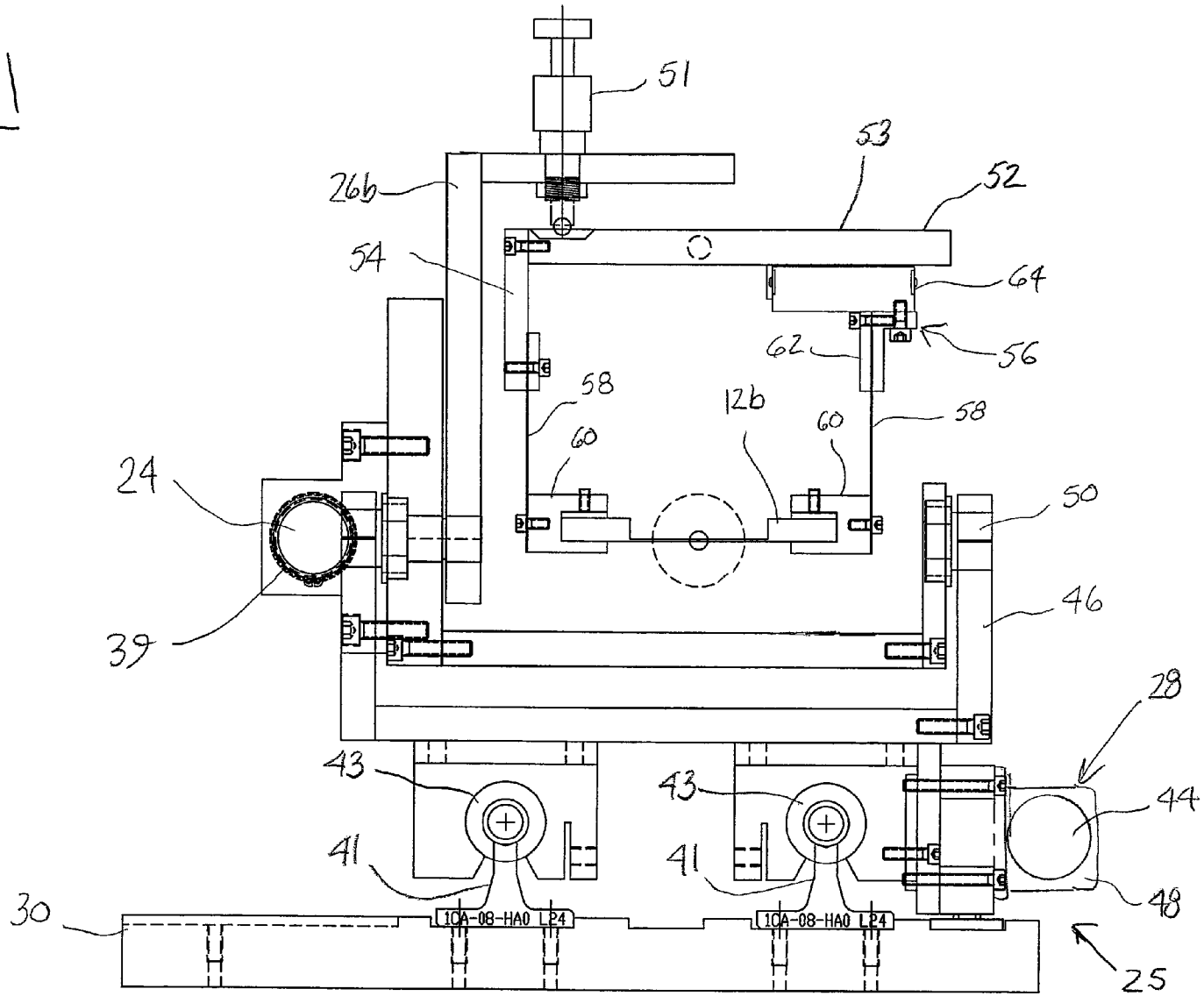
FIG. 11 is an end view of the x-ray focusing device shown in FIGS. 9 and 10.
Figure 12:
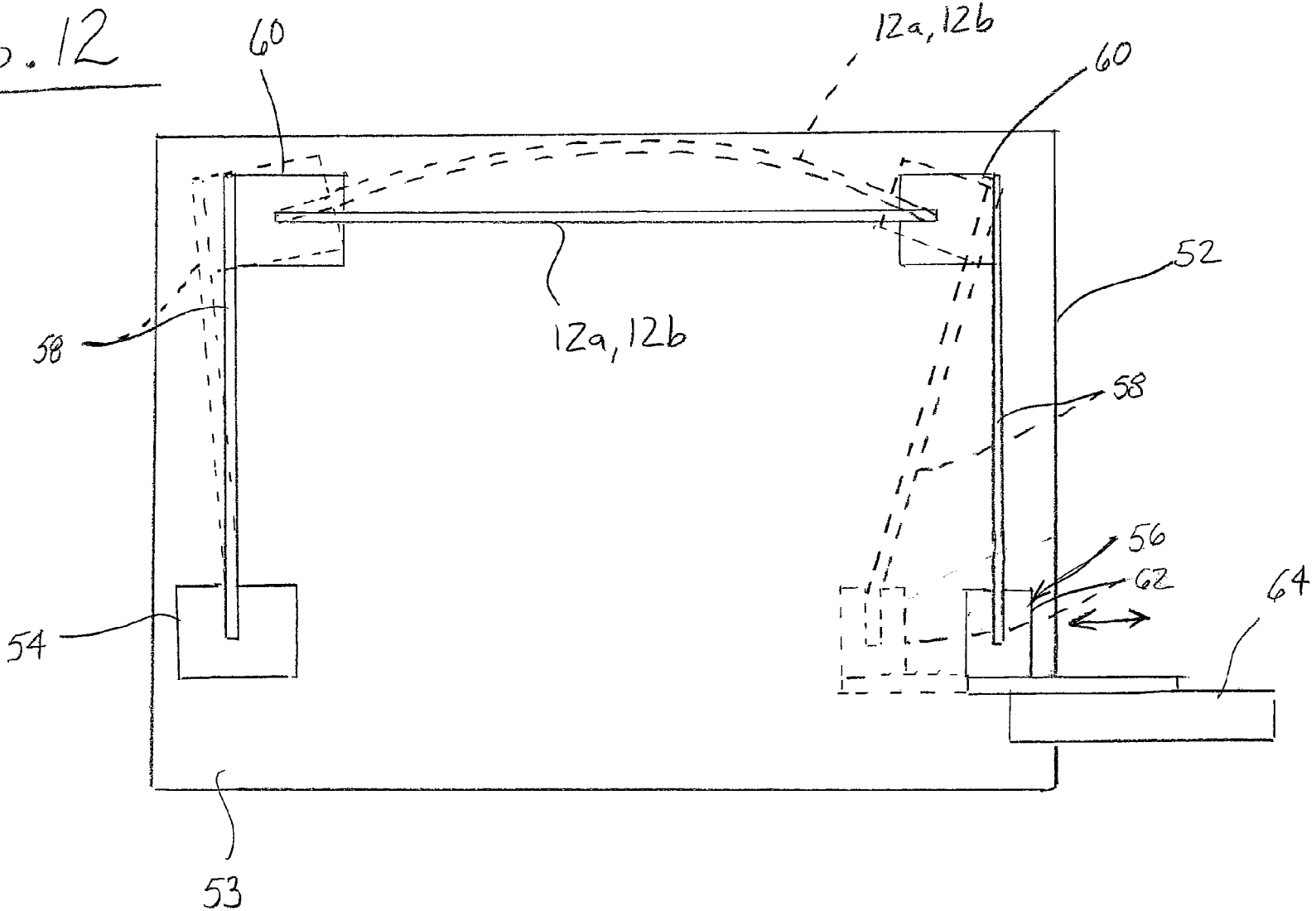
FIG. 12 is an enlarged view of one of the carriage assemblies of the present invention.

Under certain conditions, the reflectivity can be as high as 80% and the integrated reflectivity is enhanced by more than a factor of 10 by adjusting the bending of the crystals 12*a* and 12*b*. Turning now to FIGS. 11 and 12, such bending adjustment is also provided by the present invention. Each crystal 12*a* and 12*b* is supported on its respective carriage 26*a* and 26*b* via a bending unit 52. The bending unit 52 can be angularly adjusted with respect to the carriage 26*a*, 26*b* by an adjustment mechanism 51 to change the incident angle of the crystals 12*a*, 12*b* with respect to the beam source 18. The adjustment mechanism 51 can be a motor or a simple adjustment screw.

The bending unit 52 includes a base 53, a fixed support 54 attached to the base, a movable support assembly 56, a pair of deflectable arms 58 and a pair of clamping members 60. The fixed support 54 is fixed to the base 53 and has one of the deflectable arms 58 attached at one end thereto. A clamping member 60 is attached to the opposite end of the deflectable arm 58. The movable support assembly 56 includes a movable support element 62, which is translatable with respect to the base 53. Such translation can be accomplished manually via a rotatable screw mechanism, or it can be accomplished via a motor. In a preferred embodiment, a picomotor 64 with an encoder is provided on the base 53 to translate the movable support member 62.

Fixed in the movable support member 62 at one end is the other of the deflectable arms 58. At the end of the deflectable arm 58 opposite the movable support member, the other of the clamping members 60 is fixed. The crystal 12*a*, 12*b* is attached between opposite clamping members 60. Such attachment can be done in any conventional manner so that the opposite ends of the crystal 12*a*, 12*b* are fixed with respect to the clamping members 60. The deflectable arms 58 are preferably made from a spring-steel type of material so as to permit the arms to bend with respect to their supports 54 and 56.

In operation, as the movable support 62 moves toward the fixed support 60, the deflectable arms 58 will tend to bend outwardly away from each other at their ends opposite the base 53. The force generated by the outwardly bending arms 58 is transferred to the crystal 12*a*, 12*b* fixed between the clamping members 60 to cause the crystal to bend. Because of the nature of the deflectable arms 58, the bending of the crystal 12*a*, 12*b* is desirably symmetrical about a centerline defined between the two clamping members 60.

As a result of the present invention, an x-ray focusing device is provided which incorporates a highly innovative concept of using the lattice planes within sagittally bent Laue crystals, rather than parallel to the crystal's surface, to precisely focus x-rays. This is an entirely new way of focusing x-rays, (i.e., x-rays go through the crystal instead of being reflected by its surface). For the first time, a large divergence of high-energy x-rays can be focused.

The x-ray focusing device of the present invention is ideally suited for more than 100 high-energy synchrotron x-ray beamlines worldwide to provide three orders-of-magnitude increase in intensity on the sample compared to monochromators currently in use at these facilities. Each beamline costs about 10 million dollars to build and about 1 million dollars per year to operate. Each requires at least one monochromator to select a single x-ray energy. The types of synchrotron x-ray sources capable of producing high-energy x-rays are wiggler or bending-magnet devices. They typically provide a horizontal divergence of about 10 milli-radians. This product's ability to focus a large divergence thus allows full utilization of the source divergence of high-energy x-ray devices.

The high-energy x-rays produced by the present invention can be used for x-ray scattering, spectroscopy, and diffraction. Applications include material analysis, in particular residual stress analysis in structural metals under cyclic load, pharmaceutical analysis, environmental research focusing on heavy metal contamination, physical-, and biological-research using x-ray crystallography techniques. In particular, high-energy x-rays' penetrating power allows in-situ studies of materials in complex environments, such as high-pressure and elevated temperature, and the bulk properties of metals and alloys of industrial and technological importance. The present invention can also be utilized on an x-ray tube widely used for lab-based x-ray diffraction and fluorescence analysis to extend their energy range to higher x-ray energies, and to provide orders-of-magnitude increases in intensity on the sample.

Although preferred embodiments of the present invention have been described herein with reference to the accompanying drawings, it is to be understood that the invention is not limited to those precise embodiments and that various other changes and modifications may be affected herein by one skilled in the art without departing from the scope or spirit of the invention, and that it is intended to claim all such changes and modifications that fall within the scope of the invention.

The invention claimed is:

1. An x-ray focusing device comprising:

a slide pivotable about a pivot point defined at a forward end thereof;

a rail unit fixed with respect to said slide;

a forward crystal, for focusing x-rays, disposed at said forward end of said slide, said forward crystal defining a forward angle of incidence with respect to said pivot point; and a rearward crystals, for focusing x-rays, movably coupled to said slide and said rail unit at a distance rearward from said forward crystal, said rearward crystal defining a rearward angle of incidence with respect to said pivot point, wherein said slide extends in a straight line between said pivot point and said rearward crystal, and wherein pivoting of said slide about said pivot point changes said forward angle of incidence and said rearward angle of incidence of said forward and rearward crystals while simultaneously changing the distance between said forward and rearward crystals.

2. An x-ray focusing device as defined in claim 1, further comprising:

a forward carriage fixed to said forward end of said slide for supporting said forward crystal; and a movable rearward carriage for supporting said rearward crystal, said movable rearward carriage being linearly translatable along said slide and along said rail unit and defining a fixed distance between said rearward crystal and said rail unit.

3. An x-ray focusing device as defined in claim 2, wherein said movable rearward carriage comprises a rotatable bearing to allow for varying angles between said slide and said rail unit.

4. An x-ray focusing device as defined in claim 1, wherein said rail unit comprises a linear translation device for linearly translating said rearward crystal along said slide.

5. An x-ray focusing device as defined in claim 4, wherein said linear translation device comprises:

a lead screw coupled to said rearward crystal; and a motor for rotating said lead screw, wherein said rearward crystal is linearly translated along said slide.

6. An x-ray focusing device as defined in claim 5, wherein said linear translation device further comprises a translation arm threadably coupled to said lead screw, said translation arm defining a fixed distance between said rearward crystal and said lead screw.

7. An x-ray focusing device as defined in claim 1, wherein said forward and rearward crystals are sagittally bent Laue crystals having asymmetric lattice planes for focusing and diffracting x-rays.

8. An x-ray focusing device as defined in claim 7, further comprising forward and rearward bending units for respectively adjusting the sagittal bend of said forward and rearward crystals.

9. An x-ray focusing device as defined in claim 8, wherein at least one of said forward and rearward bending units comprises a pair of deflectable arms having said forward crystal or said rearward crystal attached therebetween, wherein deflection of at least one of said deflectable anus symmetrically bends said crystal about a centerline defined between said deflectable arms.

10. An x-ray focusing device comprising:

a slide pivotable about a pivot point defined at a forward end thereof;

a rail unit fixed with respect to said slide;

a forward crystal, for focusing x-rays, disposed at said forward end of said slide, said forward crystal defining a forward angle of incidence with respect to said pivot point; and a rearward crystal, for focusing x-rays, movably coupled to said slide and said rail unit at a distance rearward from said forward crystal, said rearward crystal defining a rearward angle of incidence with respect to said pivot point, wherein pivoting of said slide about said pivot point changes said forward angle of incidence and said rearward angle of incidence of said forward and rearward crystals while simultaneously changing the distance between said forward and rearward crystals, and wherein said forward and rearward crystals are sagittally bent Laue crystals having asymmetric lattice planes for focusing and diffracting x-rays, and wherein said x-ray focusing device further comprises forward and rearward bending units for respectively adjusting the sagittal bend of said forward and rearward crystals, and wherein at least one of said forward and rearward bending units comprises a pair of deflectable arms having said forward crystal or said rearward crystal attached therebetween, wherein deflection of at least one of said deflectable arms symmetrically bends said crystal about a centerline defined between said deflectable arms, and wherein the at least one of said forward and rearward bending units further comprises:

a base;

a fixed support attached to said base and having one end of a first deflectable arm attached thereto;

a movable support disposed on said base and having one end of a second deflectable arm attached thereto;

a translation mechanism for moving said movable support with respect to said fixed support to deflect said second deflectable arm; and a pair of clamping members disposed on respective ends of said first and second deflectable arms opposite said fixed support and said movable support, said forward crystal or said rearward crystal being attached between said clamping members.

11. An x-ray focusing device as defined in claim 10, wherein said translation mechanism is a picomotor.

12. An x-ray focusing device as defined in claim 1, further comprising a base, said pivot point and said rail unit being fixed to said base.

13. An x-ray focusing device as defined in claim 1, wherein said forward angle of incidence and said rearward angle of incidence of said forward crystal and said rearward crystal are reciprocal angles, whereby an x-ray beam emerging from said rearward crystal is substantially parallel to an incident beam striking said forward crystal.

14. An x-ray focusing device comprising:

a slide pivotable about a pivot point defined at a forward end thereof;

a rail unit fixed with respect to said slide;

a forward crystal, for focusing x-rays, disposed at said forward end of said slide, said forward crystal defining a forward angle of incidence with respect to said pivot point; and a rearward crystal, for focusing x-rays, movably coupled to said slide and said rail unit at a distance rearward from said forward crystal, said rearward crystal defining a rearward angle of incidence with respect to said pivot point, wherein pivoting of said slide about said pivot point changes said forward angle of incidence and said rearward angle of incidence of said forward and rearward crystals while simultaneously changing the distance between said forward and rearward crystals, and wherein said forward angle of incidence and said rearward angle of incidence of said forward crystal and said rearward crystal are reciprocal angles, whereby an x-ray beam emerging from said rearward crystal is substantially parallel to an incident beam striking said forward crystal, and wherein said pivot point is positioned about midway between said incident beam striking said forward crystal and said x-ray beam emerging from said rearward crystal.

15. A method for changing the energy of an x-ray beam focused in a device comprising:

a slide pivotable about a pivot point defined at a forward end thereof;

a rail unit fixed with respect to said slide;

a forward crystals, for focusing x-rays, linearly fixed to said forward end of said slide, said forward crystal defining a forward angle of incidence with respect to said pivot point; and a rearward crystal, for focusing x-rays, movably coupled to said slide and said rail unit at a distance rearward from said forward crystal, said rearward crystal defining a rearward angle of incidence with respect to said pivot point, said slide extending in a straight line between said pivot point and said rearward crystal, the method comprising the step of translating said rearward crystal along said slide with respect to said forward crystal, while said forward crystal remains fixed with respect to said slide thereby changing the distance therebetween, wherein said step of translating simultaneously pivots said slide about said pivot point thereby changing the incidence angles of said forward and rearward crystals.

16. A method as defined in claim 15, wherein said rail unit comprises a lead screw and a motor, said lead screw being coupled between said motor and said rearward crystal, and wherein said step of translating comprises the step of rotating said lead screw with said motor to translate said rearward crystal along said slide.

17. A method as defined in claim 16, wherein said translating step comprises the step of maintaining a fixed distance between said lead screw and said rearward crystal.

18. A method as defined in claim 15, wherein said forward and rearward crystals are sagittally bent Laue crystals having asymmetric lattice planes for focusing and diffracting x-rays.

19. A method as defined in claim 18, further comprising the step of changing the bend of at least one crystal to adjust focusing of the x-rays.

20. A method as defined in claim 15, wherein said forward angle of incidence and said rearward angle of incidence of said forward crystal and said rearward crystal are reciprocal angles, whereby an x-ray beam emerging from said rearward crystal is substantially parallel to an incident beam striking said forward crystal.

21. A method for changing the energy of an x-ray beam focused in a device comprising:

a slide pivotable about a pivot point defined at a forward end thereof;

a rail unit fixed with respect to said slide;

a forward crystal, for focusing x-rays, disposed at said forward end of said slide, said forward crystal defining a forward angle of incidence with respect to said pivot point; and a rearward crystal, for focusing x-rays, movably coupled to said slide and said unit at a distance rearward from said forward crystal, said rearward crystal defining a rearward angle of incidence with respect to said pivot point, wherein said forward angle of incidence and said rearward angle of incidence of said forward crystal and said rearward crystal are reciprocal angles, whereby an x-ray beam emerging from said rearward crystal is substantially parallel to an incident beam striking said forward crystal, and wherein said pivot point is positioned about midway between said incident beam striking said forward crystal and said x-ray beam emerging from said rearward crystal, the method comprising the step of translating said rearward crystal along said slide with respect to said forward crystal, thereby changing the distance therebetween, wherein said step of translating simultaneously pivots said slide about said pivot point thereby changing the incidence angles of said forward and rearward crystals.

* * * * *